US005383758A

United States Patent [19]

Patrick

[11] Patent Number: 5,383,758

[45] Date of Patent: Jan. 24, 1995

[54] LOAD POSITIONING ARM

[75] Inventor: William E. Patrick, Wenatchee, Wash.

[73] Assignee: Lift Mates, Inc., Wenatchee, Wash.

[21] Appl. No.: 949,039

[22] Filed: Sep. 21, 1992

[51] Int. Cl.[6] ..... B66C 1/00

[52] U.S. Cl. ..... 414/680; 414/10; 414/607; 414/672

[58] Field of Search ..... 414/607, 641, 642, 643, 414/663, 672, 589, 590, 10, 728, 738, 743, 680

[56] References Cited

U.S. PATENT DOCUMENTS

| | | | |
|---|---|---|---|
| 2,752,056 | 6/1956 | Lull . | |
| 3,087,630 | 4/1963 | Karnow et al. . | |
| 3,409,158 | 11/1968 | Lull . | |
| 3,984,009 | 10/1976 | Holroyd | 414/728 |
| 4,147,263 | 4/1979 | Frederick et al. | 414/728 X |
| 4,260,320 | 4/1981 | Steiger | 414/680 |
| 4,392,524 | 7/1983 | Bauch | 165/76 |
| 4,579,504 | 4/1986 | Lemme et al. | 414/607 |
| 4,666,360 | 5/1987 | Harms et al. | 414/607 |
| 4,666,365 | 5/1987 | Cradeur | 414/746 |
| 4,676,713 | 6/1987 | Voelpel | 901/29 X |
| 4,864,239 | 9/1989 | Casarcia et al. | 901/29 X |

*Primary Examiner*—Donald W. Underwood
*Attorney, Agent, or Firm*—Christensen, O'Connor, Johnson & Kindness

[57] ABSTRACT

Apparatus for positioning a load in any orientation. The apparatus includes a base with an attached lift arm that has a plurality of members slidably interconnected. At least one of the plurality of members is pivotally attached to the base, and a rotatable connector is attached to at least one other of the plurality of members opposite the base. A carriage is provided at the distal end of the lift arm. The carriage includes a carrier pivotally attached to the rotatable connector and a track slidably connected to the carrier. Straps and clamps secure a load such as a pipe to the carrier. The apparatus also includes a hydraulic power system to position the lift arm and the carriage. The power system controls (a) pivotal movement of the lift arm about the pivot connection between the base and the lift arm, relative to the base, (b) translational movement of the plurality of members relative to each other along the slidable interconnections, (c) rotational movement of the rotatable connector relative to the plurality of members, (d) pivotal movement of the lift arm relative to the carriage, and (e) translational movement of the track relative to the carrier. Using the load positioning arm, construction materials and other objects that are attached to the track can be selectively and accurately pivoted, extended, rotated, tilted, and translated relative to the base.

7 Claims, 6 Drawing Sheets

LOAD POSITIONING ARM

FIELD OF THE INVENTION

This invention relates generally to an apparatus for positioning loads, and more particularly, to an improved apparatus for positioning construction materials, the apparatus being attachable to and liftable by a conventional lift truck.

BACKGROUND OF THE INVENTION

Lifting and positioning heavy objects during construction of a building often requires the combined efforts of a lift truck and one or more workers. The lift truck raises the object to the required height, and the workers shift the object on the forks of the lift truck so that the object is aligned or fits with other materials that are already in place. Construction in this manner can be a slow, difficult, and sometimes dangerous task, requiring several workers to maneuver the load into place if it is heavy and/or awkward to handle. This problem is not limited to the construction industry. For example, ware housing facilities are also faced with the problem of lifting and positioning building materials such as pipe, that must be stacked on shelving or in piles. Such materials must frequently be maneuvered into place after being raised, by repeated backing and turning the lift truck. Recognizing that the problem of lifting and maneuvering heavy objects exists in many industrial applications, others have attempted to develop devices that facilitate the handling of such loads.

For instance, apparatus for positioning structural members is disclosed in U.S. Pat. No. 3,409,158 (Lull). The patent describes a cage that is attached to the forks of a lift truck and contains hydraulic devices to rotate, pivot, and translate structural members into position. Lull's apparatus has several limitations, however, including its inability to translate members in more than one direction, its inability to lift objects except by means of the lift truck, and its inability to pivot an object relative to the base of the cage. In many circumstances, these limitations make precise positioning of materials difficult to accomplish, since the lift truck itself may need to be moved several times to achieve the desired positioning of an object, instead of simply positioning the lift truck in the general location and thereafter performing all precise positioning of the object solely by operator control of Lull's patented apparatus.

A materials handler is also disclosed in U.S. Pat. No. 3,087,630 (Karnow). This prior art materials handler is a relatively intricate and complicated omnidirectional manipulator that is unable to move and position materials over more than small incremental distances—at least not without repositioning the lift truck to which it is attached.

U.S. Pat. Nos. 4,392,524 (Bauch) and 4,666,365 (Cradeur) disclose lifts for handling heat exchanger bundles. The inventions disclosed in these two patents are not likely to be more useful than a simple forklift for lifting objects other than heat exchangers, since their ability to position an object is limited. For example, neither of these patents disclose means to tilt an object or means for pivoting the object.

In consideration of the limitations of the devices disclosed in the prior art discussed above, it should be apparent that an effective solution to the problem of positioning a load is not currently known. Accordingly, the present invention was developed, and it provides significant advantages over the prior art devices for handling materials that must be lifted and precisely positioned.

SUMMARY OF THE INVENTION

In accordance with this invention, a device for positioning materials is provided that comprises a base, a lift arm, a carriage, and power means for positioning the lift arm and carriage. The lift arm includes a plurality of members that are slidably interconnected, one of the members being pivotally attached to the base, and a rotatable connector being attached to another of the members opposite the base. The carriage includes a carrier pivotally attached to the rotatable connector and a track that is slidably connected to the carrier. The track also has attachment means for securing materials to be positioned. The power means control movement between the interconnected components, including: the pivotal movement of the lift arm relative to the base about the pivot connection between the base and the lift arm, the translational movement of the members relative to each other along the slidable interconnections, the rotational movement of the rotatable connector relative to the members, the pivotal movement of the carriage relative to the lift arm, and the translational movement of the track relative to the carrier. Through the use of the power means, materials supported by the track can be selectively pivoted, extended, rotated, tilted, and translated relative to the base.

In accordance with a particular aspect of this invention, the base of the device is attached to a lift cage. The lift cage has brackets that are sized to accept lift truck forks.

In accordance with another aspect of this invention, the power means comprise a hydraulic system, including hydraulic linear actuators and at least one rotary actuator to cause movement between the various components. In one embodiment, the hydraulic system, including a fluid tank and a pump, is contained within the lift cage. In another embodiment, the hydraulic system is supplied with pressurized hydraulic fluid from the lift truck, which supports the lift cage.

In accordance with another aspect of this invention the slidably interconnected members comprise a telescoping boom having a mast and a pilot boom. The mast is connected to the base, and the pilot boom supports the rotatable connector.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
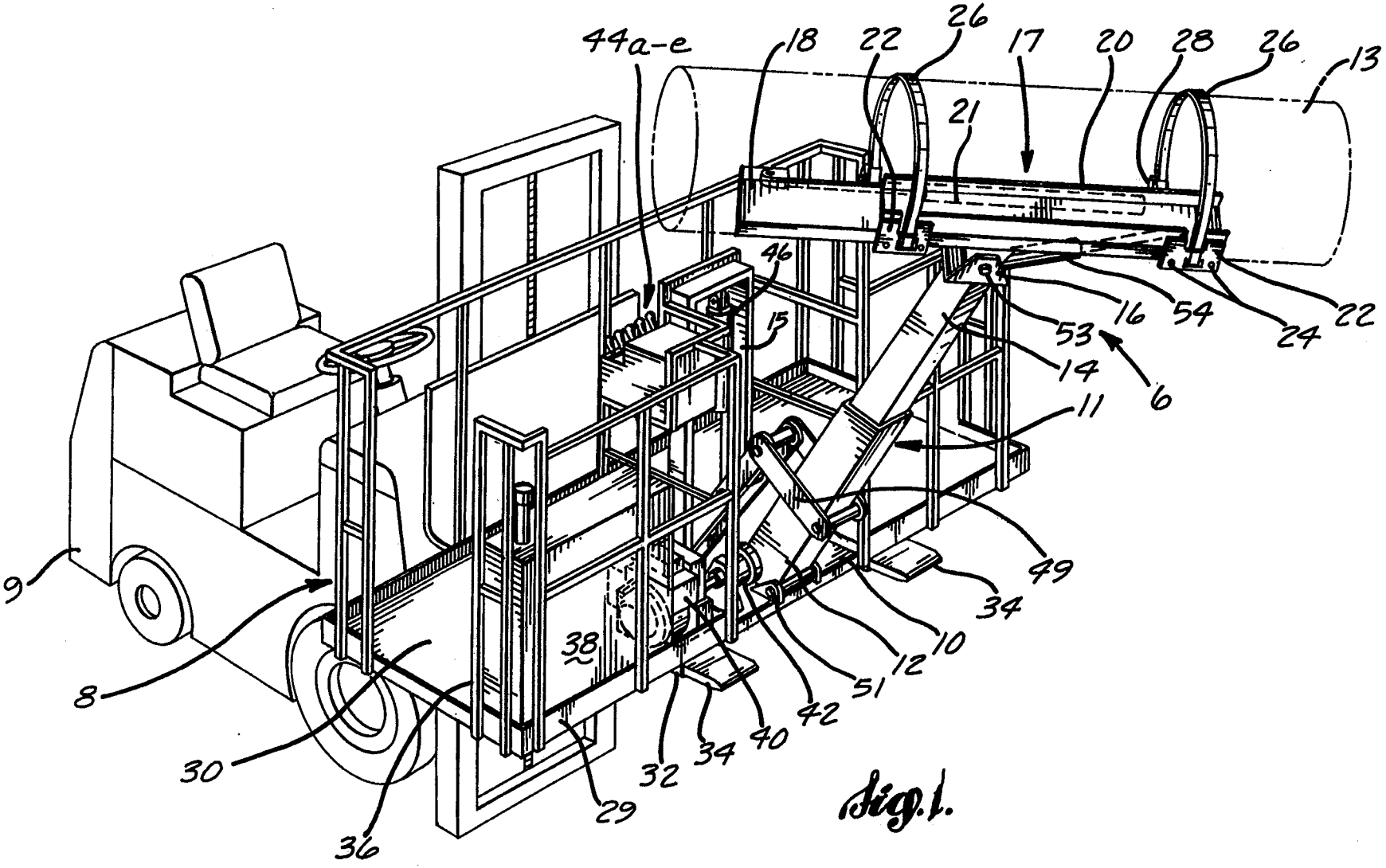
FIG. 1 is a perspective view of the invention, illustrating its use on the forks of a lift truck during the positioning of a load.

A first preferred embodiment of a load positioning arm 6 is illustrated in FIG. 1. Load positioning arm 6 is mounted on a lift cage 8, which is intended to be raised to a working height by a vehicle such as a lift truck 9 having forks 34 that engage and carry lift cage 8. Lift cage 8 is designed so that most conventional hydraulic lift vehicles can be used to carry lift cage 8. A pipe load 13 (shown in phantom view) is illustrated as an example of the many types of loads that can be carried and accurately positioned by load positioning arm 6, for example, at a construction site or in a warehouse.

As can be seen in FIG. 1, pipe load 13 can be raised and positioned by movement through several degrees of freedom without the need to move lift truck 9. Pipe load 13 has been pivoted, extended, rotated, tilted, and translated with load positioning arm 6 to arrive at the position shown in FIG. 1. The present invention accomplishes the positioning of loads, such as the pipe shown in FIG. 1, by simply positioning lift truck 9 in the general location where the load is to be stacked, fitted, or installed, hoisting lift cage 8, and controllably precisely positioning the object with load positioning arm 6.

Load positioning arm 6 includes a base 10, a lift arm 11, and a carriage 17. Base 10 provides a surface on which to mount lift arm 11 and an upright support 15. Lift arm 11 comprises a mast 12 that is pivotally connected to the lower front edge of base 10 and a pilot boom 14 having a proximal end that is slidably connected in a telescoping fashion to mast 12, so that the pilot boom can be extended to move a load along a longitudinal axis of mast 12. One side of a rotatable connector 16 is rotatably attached to a distal end of pilot boom 14, and the other side of rotatable connector 16 is pivotally attached to a carrier 18, providing a rotational and pivotal connection between pilot boom 14 and a carriage 17.

A track 20 is slidably connected to carrier 18. Track 20 includes an I-beam configuration having a central rib 21 and top and bottom flanges formed by attachment plates 22 and rollers 24 that slide along carrier 18. Rollers 24 are disposed at both ends of track 20, being positioned to roll along carrier 18 which is nested in the track when track 20 is translated along a longitudinal axis of carrier 18. In the preferred embodiment, track 20 is provided with straps 26 and clasps 28 to secure pipe load 13 to the track; however, other means for supporting a load are contemplated, such as curved forks and hydraulically actuated jaws (neither shown).

FIG. 1 also illustrates the use of lift cage 8. Lift cage 8 includes a main supporting frame 29 to which base 10 is attached. Also attached to main supporting frame 29 is floor 30 and brackets 32, which are disposed under the floor in parallel alignment with each other. Brackets 32 receive forks 34 on lift truck 9, securing lift cage 8 to the lifting mechanism of the lift truck. Also attached to main supporting frame 29 is a guard railing 36. A hydraulic fluid tank 38, a prime mover 40 (e.g., an internal combustion engine), a hydraulic pump 42, and control levers 44*a–e* that actuate hydraulic valves 64*a–e* (not shown in FIG. 1) that control the flow of hydraulic fluid pressurized by hydraulic pump 42 are all disposed within lift cage 8.

Figure 2A:
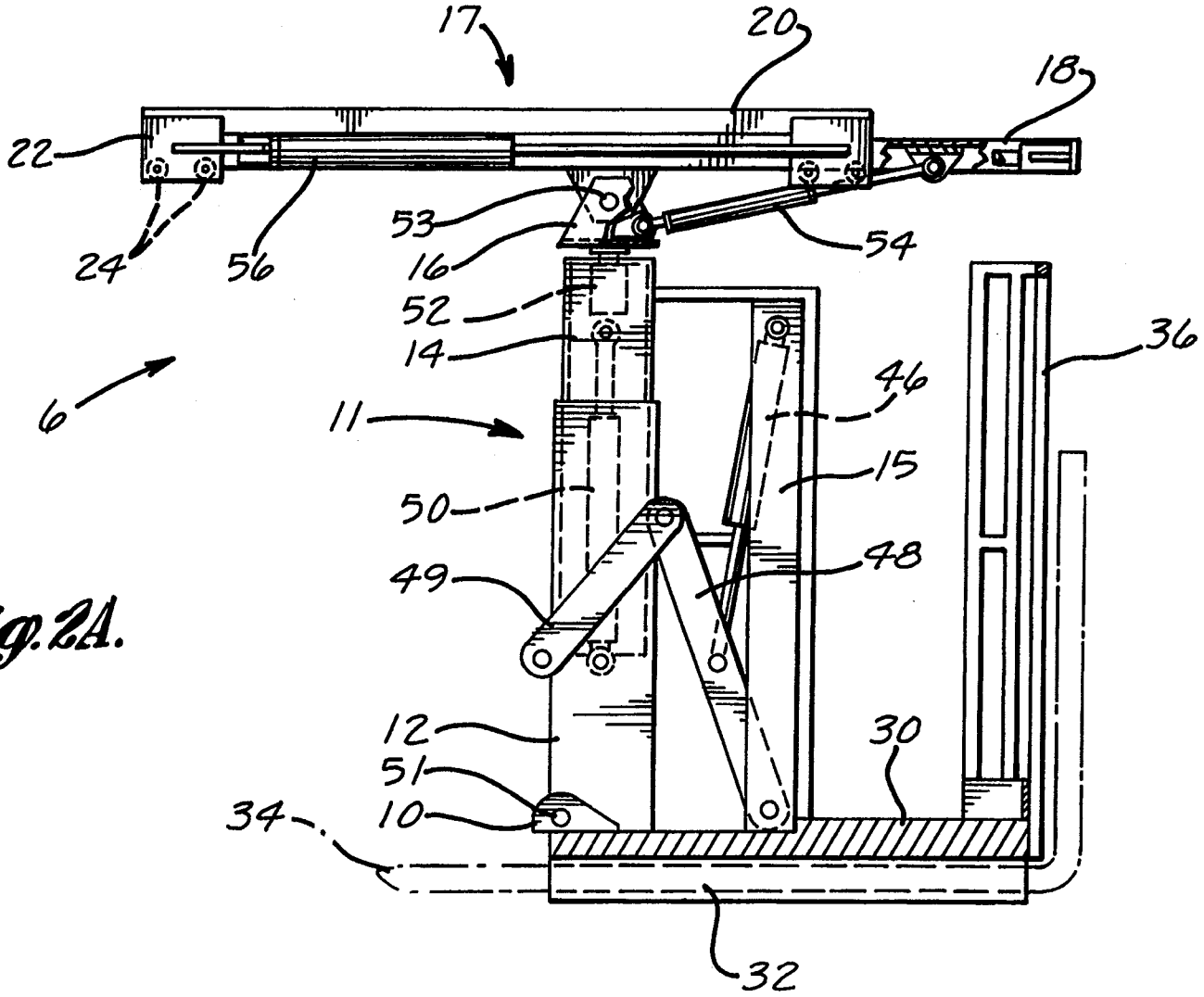
FIG. 2*a* is a side elevational view of the invention, showing a carriage rotated 90° relative to a base, illustrating placement of its movement actuators.

In FIG. 2A, power means are shown for controlling the movement of lift arm 11 and carriage 17. The power means include a first hydraulic linear actuator 46, a first linkage arm 48, and a second linkage arm 49. First hydraulic linear actuator 46 is pivotally connected at one end to the top of upright support 15 and at the other end to the midsection of first linkage arm 48. First linkage arm 48 is pivotally connected at one end to the bottom of upright support 15 and at the other end to second linkage arm 49. Second linkage arm 49 is pivotally connected to the front midsection of mast 12. First hydraulic linear actuator 46 pivotally moves mast 12 relative to base 10. A second hydraulic linear actuator 50 extends between mast 12 and pilot boom 14, to which its opposite ends are connected, and thus effects the telescopic sliding motion of pilot boom 14 relative to mast 12. Within the upper end of pilot boom 14 is a hydraulic rotary actuator 52. Hydraulic rotary actuator 52 interconnects rotatable connector 16 and pilot boom 14 and produces rotational movement between the two when activated with pressurized hydraulic fluid. A third hydraulic linear actuator 54 is connected between rotatable connector 16 and carrier 18 and produces a tilting movement of carrier 18 relative to rotatable connector 16, by pivoting carrier 18 about its connection to rotatable connector 16. Finally, a fourth hydraulic linear actuator 56 is connected between track 20 and carrier 18. Fourth hydraulic linear actuator 56 causes translational movement of track 20 relative to carrier 18.

Figure 2B:
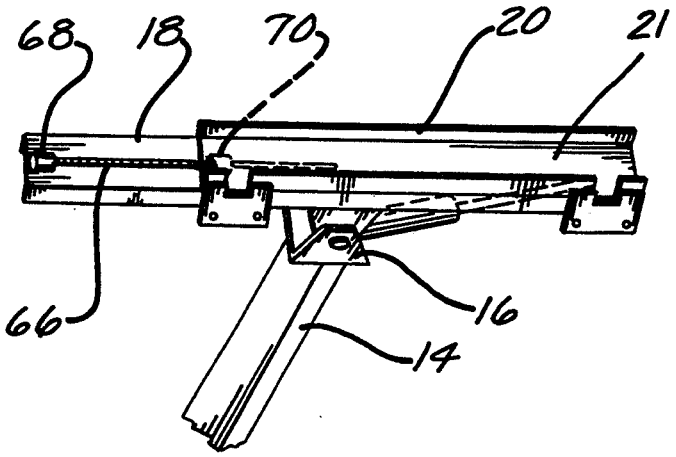
FIG. 2*b* is a perspective view of an alternate embodiment of the invention, illustrating means for controlling translational movement.

FIG. 2B illustrates an alternate embodiment of the invention's means for causing translational movement of track 20. A threaded shaft 66 rotated by an electric or a hydraulic motor 68 attached to carrier 18 can be used to translate track 20 relative to carrier 18, in response to rotation of threaded shaft 66 moving a threaded nut 70 that is captively attached to track 20.

Figure 4:
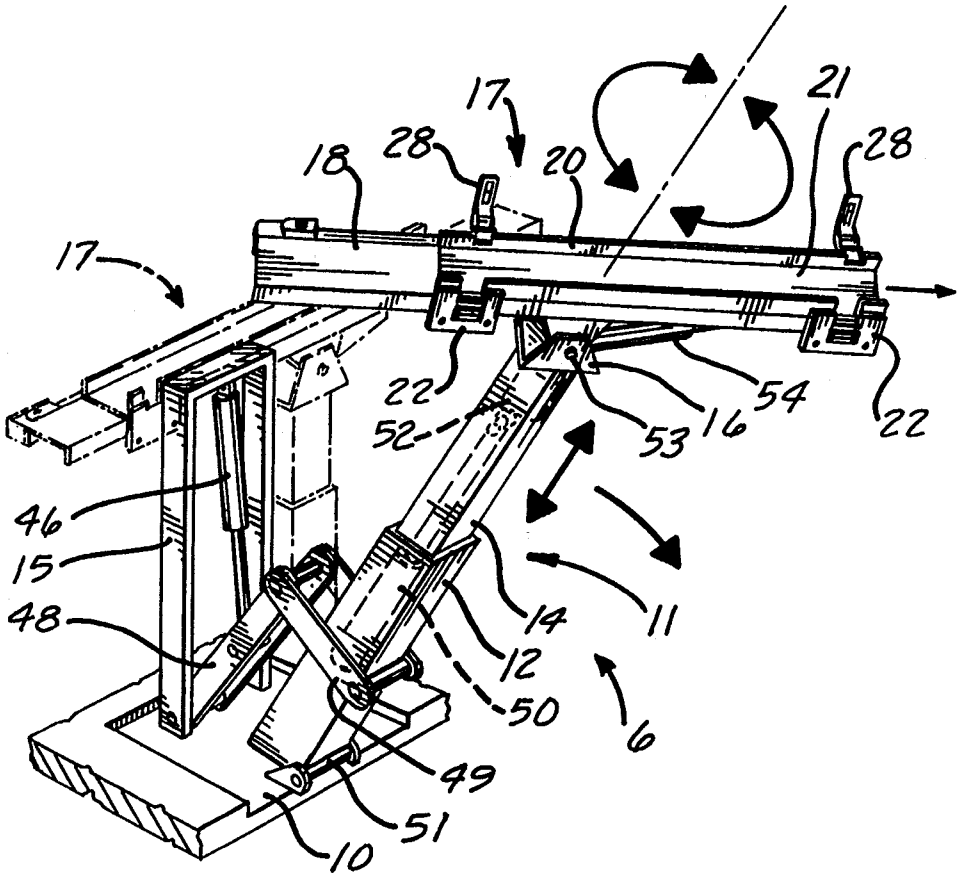
FIG. 4 is a perspective view of the load positioning arm, illustrating pivotal, rotational, and translational movement of a load.
Figure 3:
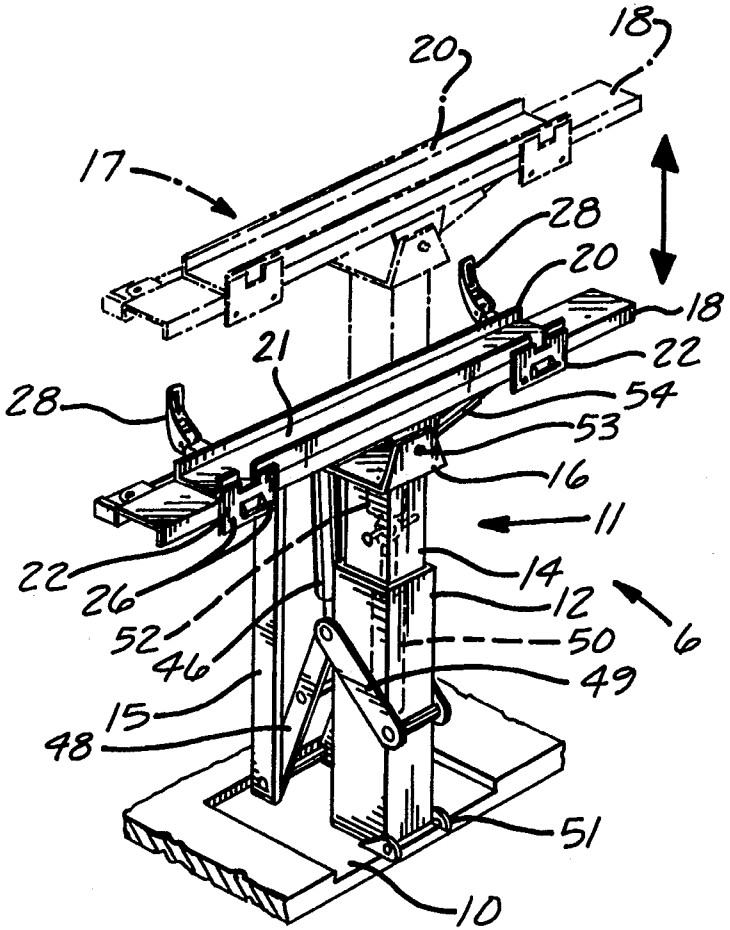
FIG. 3 is a perspective view of the invention, illustrating vertical movement of a supported load.
Figure 5:
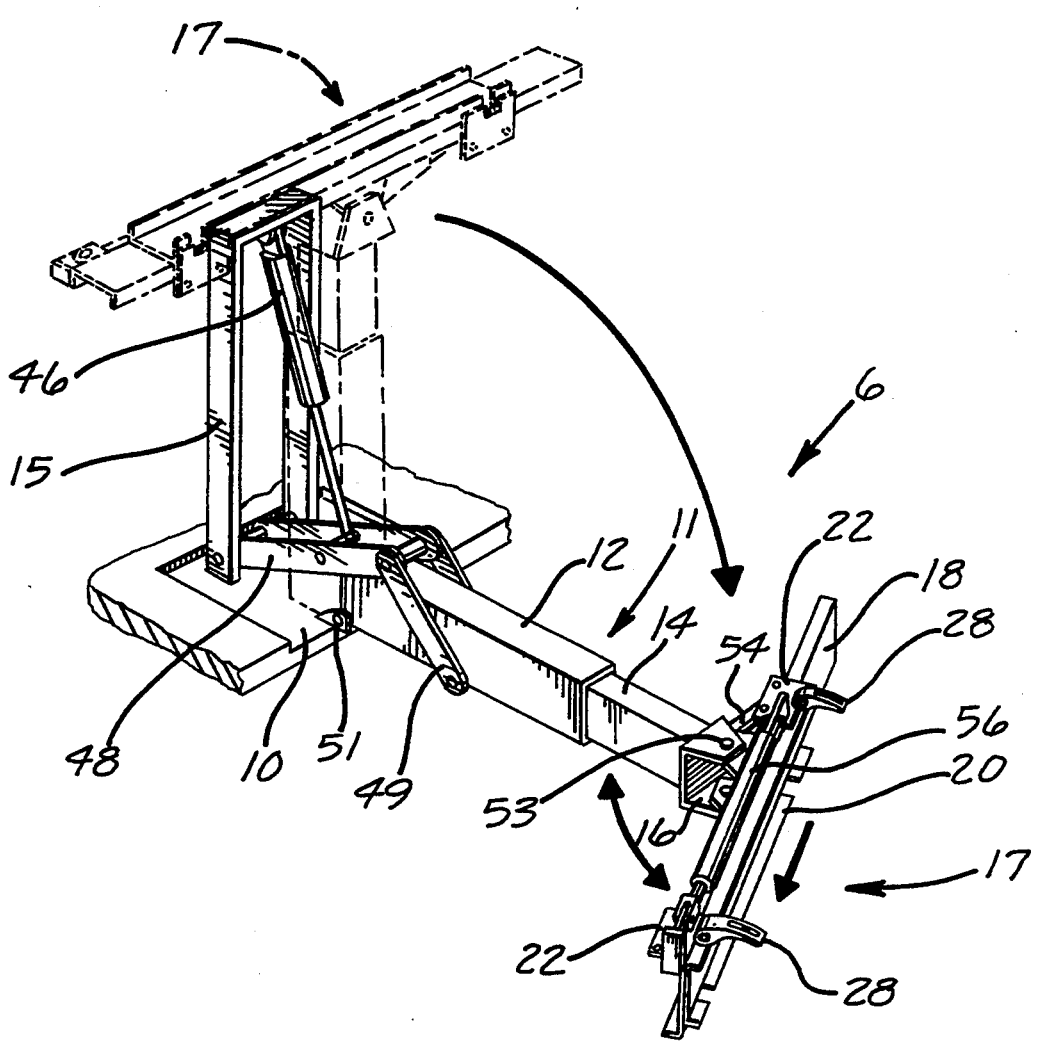
FIG. 5 is a perspective view of the load positioning arm, illustrating pivotal, tilting, and translational movement of a load.

FIGS. 3, 4, and 5 illustrate the different degrees of freedom in which load positioning arm 6 can move in response to the power means being activated to position any load that is attached to track 20. For example, in FIG. 3 a phantom view illustrates a vertical extension of lift arm 11 caused by movement of pilot boom 14 relative to mast 12. This movement is accomplished by controllably supplying a flow of pressurized hydraulic fluid to second hydraulic linear actuator 50 and allows an operator to extend (raise or lower) a load attached to track 20 without having to rely solely upon lift truck 9. If, for example, load positioning arm 6 were attached to lift cage 8, which is in turn carried by lift truck 9, lift truck 9 is used to position lift cage 8 at the general location in which the load is to be positioned, and precise extension positioning of the load vertically can then be accomplished wholly or in part through use of the telescoping movement of arm 11.

Other ways in which load positioning arm 6 can position a load that is carried on track 20 are illustrated in FIGS. 4 and 5. Pivotal movement of lift arm 11 relative to base 10 is accomplished by extending first hydraulic linear actuator 46 such that linkage arms 48 and 49 cause mast 12 to pivot about a pivot pin 51 relative to base 10. This movement pivots a load out and away from base 10. It should be noted that second hydraulic linear actuator 50 can be used to extend lift arm 11 while lift arm 11 is pivoted at an angle relative to base 10 by first hydraulic linear actuator 46, so that lift arm 11 can be extended not only in a vertical direction but in any direction in which lift arm 11 is pivotally angled by first hydraulic linear actuator 46.

FIG. 4 includes a view of lift arm 11 and carriage 17 that illustrates the rotational movement of rotatable connector 16 relative to pilot boom 14. This rotational movement is effected by controllably supplying pressurized hydraulic fluid through hydraulic rotary actuator 52, which rotates carriage 17 relative to lift arm 11. This view also shows track 20 in a position after being translated to one end of carrier 18.

FIG. 5 illustrates the tilting movement of carriage 17 relative to rotatable connector 16 about a pivot pin 53, which is accomplished by controllably supplying pressurized hydraulic fluid to third hydraulic linear actuator 54. Carrier 18 is pivotally connected to rotatable connector 16 by pivot pin 53 so that by activating third hydraulic linear actuator 54, which is connected between the two, tilting movement of carriage 17 is effected.

Finally, translational movement of track 20 relative to carrier 18 is shown in FIG. 5. This movement is caused by supplying pressurized hydraulic fluid to fourth hydraulic linear actuator 56, which is connected between track 20 and carrier 18. Fourth hydraulic linear actuator 56 moves track 20 along the longitudinal axis of carrier 18.

Figure 6:
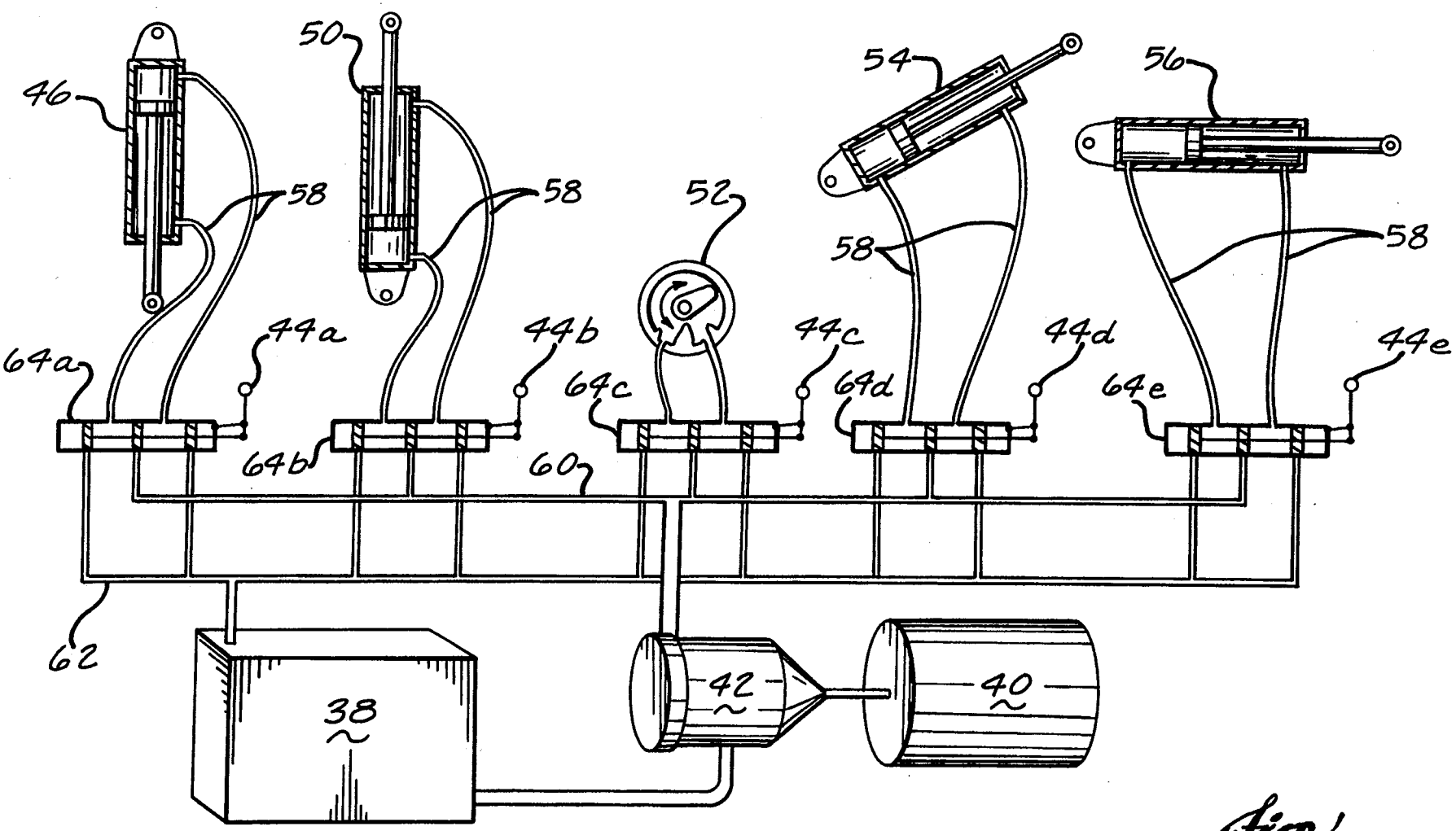
FIG. 6 is a simplified schematic illustration of the hydraulic power system of the invention.

FIG. 6 illustrates the basic simplified setup of the control and power means of the invention. Details such as flow regulators and relief valves have not been shown. Following the path of fluid flow in FIG. 6, hydraulic fluid is supplied to pump 42 from hydraulic fluid tank 38. Pump 42, drawn by prime mover 40, pressurizes the hydraulic fluid and supplies it through high pressure feed hoses 60, to valves 64*a–e*. Valves 64*a–e* are operator controlled by the use of control levers 44*a–e* to supply high pressure fluid to the hydraulic actuators. It should be understood that valves 64*a–e* could be flow/no flow valves or proportional valves that increase the fluid pressure to the actuator depending on the extent to which the control lever is moved from a center detent position. Linear actuators 46, 50, 54, and 56 are conventional double-acting hydraulic cylinders. For example, opening valve 64*a* by moving control lever 44*a* allows fluid to flow through valve 64*a* and through one of actuator hoses 58 to one side of linear actuator 46, thus controlling the movement of actuator 46. Valve 64*a* also permits fluid to flow out of the other end of linear actuator 46 through another of actuator hoses 58 and through return hoses 62 to tank 38. The operation of the other actuators 50, 52, 54, and 56 is similar. It should be noted with regard to rotary actuator 52 that a vane-type actuator is shown in FIG. 6. In the preferred embodiment a Helac Model HP-16KS-FL-180-O-H is used.

The hydraulic fluid lines 58, 60, 62 that interconnect hydraulic fluid tank 38, hydraulic pump 42, hydraulic valves 64*a–e*, and hydraulic actuators 46, 50, 52, 54, and 56 are not shown in FIGS. 1–5 to simplify the illustrations. Also, by way of definition, it is to be understood that references herein to hydraulic linear actuators, hydraulic cylinders, or hydraulic rams, encompass any conventional double-acting hydraulic piston/cylinder assembly or pairs of opposed single-acting piston/cylinder assemblies. Likewise, references to rotary actuators encompass any conventional double-acting or opposed pairs of single-acting hydraulic rotary actuators. The hydraulic actuators and controls used in this invention are conventional and well known to those of ordinary skill in the art.

The preferred embodiment of the invention as shown in FIG. 1 is controlled by an operator standing within cage 8 who moves control levers 44*a–e* to operate hydraulic valves 64*a–e* that control the flow of pressurized hydraulic fluid supplied by hydraulic pump 42 to selected hydraulic linear or rotary actuators. The operator can thus precisely position a load carried to a general location and perhaps partially raised by lift truck 9. A load such as pipe 13 would first be secured to track 20 by the use of straps 26 and clasps 28. Lift truck 9 would then be used to move load positioning arm 6 with the attached load to the location where the load is to be positioned and would typically elevate lift cage 8 to a height a few feet below that at which the load is to be placed. As noted above, the lift truck operator climbs into cage 8 and uses control levers 44*a–e* to control load positioning arm 6. Alternately, another worker may already be in the cage before it is raised by the lift truck. Through the use of control levers 44*a–e*, the operator can pivot the load by using first hydraulic linear actuator 46, extend the load upwardly or outwardly by using second hydraulic linear actuator 50, rotate the load by using rotary actuator 52, tilt the load by using third hydraulic linear actuator 54, and translate the load from side-to-side by using fourth hydraulic linear actuator 56. The complete range of control thereby provided by load positioning arm 6 allows the operator to precisely position the load in any orientation and without any manual handling by other workers.

The advantages of the invention are numerous. By using the invention in the manner described above, lift truck 9 does not have to be relied upon for precise positioning, one operator can do the work of several, and heavy or awkward loads can be easily manipulated without endangering the operator. Another more specific advantage is the ability of load positioning arm 6 to position pipe 13 or another object end-to-end to join with a like article, by positioning the pipe or object so that it can be finally moved axially into place by translational movement of track 20.

Alternate embodiments of the invention include a load positioning arm 6 with lift cage 8 omitted, and using a hydraulic system on lift truck 9 to provide the pressurized hydraulic fluid that is supplied to the hydraulic actuators to move load positioning arm 6. It is also contemplated that electric motors, pneumatic actuators, and other types of linear actuators and rotary actuators can be used in place of the hydraulic linear and rotary actuators discussed above. Other embodiments of the invention can include customized attachments to be used with track 20 to handle and position different materials and loads having specialized shapes or characteristics.

While the preferred embodiment of the invention has been illustrated and described, along with several alternative embodiments, it will be appreciated that various other changes can be made therein without departing from the spirit and scope of the invention.

The embodiments of the invention in which an exclusive property or privilege is claimed are defined as follows:

1. Apparatus attachable to a lift truck for an operator to use to position materials, the apparatus comprising:

(a) a base having:

(i) at least one bracket arranged and configured for coupling to the lift truck; and (ii) a platform on which the operator may be located to operate the apparatus;

(b) a lift arm having:

(i) a plurality of members slidably interconnected, said plurality of members having a proximal end and a distal end; the proximal end of said plurality of members being pivotally attached to said base for swinging movement in a fore and aft direction; and (ii) a rotatable connector mounted for rotation in a plane transverse to the longitudinal axis of said plurality of members on the distal end of said plurality of members;

(c) a carriage having:

(i) a carrier pivotally attached to said rotatable connector for swinging movement about a second axis parallel to said plane; and (ii) a track having attachment means for securing materials, said track being slidably connected to said carrier for movement in a direction transverse to said second axis, wherein said track includes a plurality of rollers disposed at both ends of said track that engage said carrier, said plurality of rollers being positioned to roll along said carrier when said track is translated relative to said carrier, said track being formed from a central rib and top and bottom flanges such that said track has an I-beam configuration, said carrier nesting at least partially within one side of said track between one side of the top and bottom flanges, the flanges on the other side of said track being arranged and configured to secure a pipe load for positioning, the top and bottom flanges extending parallel to the direction of the pipe load; and (d) power means for positioning said lift arm and said carriage including:

(i) first means connected between said base and said lift arm for controlling pivotal movement of said lift arm relative to said base about the pivot connection between said base and said lift arm;

(ii) second means connected between each of said plurality of members and another of said plurality of members for controlling translational movement of said plurality of members relative to each other along the slidable interconnections;

(iii) third means connected between said plurality of members and said rotatable connector for controlling rotational movement of said rotatable connector relative to said plurality of members;

(iv) fourth means connected between said carrier and said rotatable connector for controlling pivotal movement of said carriage relative to said rotatable connector;

(v) fifth means connected between said track and said carrier for controlling translational movement of said track relative to said carrier; so that the materials can be selectively pivoted, extended, rotated, tilted, and translated relative to said base by selective control of said power means; and (vi) a power supply mechanism attached to said base for providing power to at least one of said first, second, third, fourth, and fifth means.

2. The apparatus of claim 1, wherein said means for controlling translational movement of said track relative to said carrier comprise at least one hydraulic ram.

3. The apparatus of claim 1, wherein said means for controlling translational movement of said track relative to said carrier comprise at least one threaded shaft.

4. Apparatus for positioning a load, in cooperation with a lift truck having forks, the apparatus comprising:

(a) a base having brackets arranged and configured to accept the lift truck forks;

(b) a mast pivotally connected to said base, having first power means connected between said mast and said base, for controlling pivotal movement between said mast and said base;

(c) a pilot boom having a distal end and a proximal end, said proximal end being partially disposed within said mast and slidably connected to said mast, and second power means, connected between said mast and said pilot boom, for controlling translational movement of said pilot boom relative to said mast in a direction parallel to a longitudinal axis of said mast;

(d) a rotatable connector attached directly to the distal end of said pilot boom, having third power means for controlling rotational movement of said rotatable connector relative to said pilot boom in a plane substantially perpendicular to a longitudinal axis of said pilot boom;

(e) a carrier pivotally attached to said rotatable connector, having fourth power means connected between said carrier and said rotatable connector, for controlling pivotal movement between said carrier and said rotatable connector; and (f) a track slidably connected to said carrier, having fifth power means for controlling translational movement of said track relative to said carrier, said track engaging the load so as to move the load with said track, the load being selectively pivoted, extended, rotated, tilted, and translated relative to said base, said apparatus further comprising attachment means connected to said track for securing the load to the track, said track having an I-beam configuration for securement of loads on one side of said track and nesting at least partially over said carrier with the other side of said track.

5. The apparatus of claim 4, wherein said first power means comprises a linear actuator connected to said frame and linkage members connected between said linear actuator and said mast, said linkage members including a first bar and a second bar, said first bar extending from said base to said second bar and said second bar extending from said first bar to said mast, said linear actuator being connected to said first bar, such that extension of said linear actuator causes said first and second bars to move said mast outwardly, away from said frame, said mast having a range of motion from vertical to substantially horizontal as said mast is pivoted about its connection to said base.

6. The apparatus of claim 5, wherein said first, second, third, fourth, and fifth power means comprise hydraulic actuators; the apparatus further comprising a hydraulic fluid supply system including a fluid tank and a pump attached to said base, said supply system being arranged and configured to supply pressurized hydraulic fluid to said hydraulic actuators.

7. The apparatus of claim 6, wherein said mast comprises a polygonal mast beam and said pilot boom comprises a polygonal pilot beam at least partially disposed within said mast beam; said second power means comprising a second linear hydraulic actuator being partially disposed within said mast beam and partially disposed within said pilot beam, one end of said second linear hydraulic actuator being connected to said pilot beam and the other end of said second linear hydraulic actuator being connected to said mast beam.

* * * * *